US009384705B2

(12) United States Patent
Ryu et al.

(10) Patent No.: US 9,384,705 B2
(45) Date of Patent: Jul. 5, 2016

(54) GATE DRIVER AND DISPLAY APPARATUS INCLUDING THE SAME

(71) Applicant: Dongbu Hitek Co., Ltd., Gyeonggi-do (KR)

(72) Inventors: Choong Sik Ryu, Gyeonggi-do (KR); Eun Mee Lee, Gyeonggi-do (KR)

(73) Assignee: Dongbu Hitek Co., Ltd. (KR)

( * ) Notice: Subject to any disclaimer, the term of this patent is extended or adjusted under 35 U.S.C. 154(b) by 0 days.

(21) Appl. No.: 14/318,565

(22) Filed: Jun. 27, 2014

(65) Prior Publication Data

US 2015/0294635 A1 Oct. 15, 2015

(30) Foreign Application Priority Data

Apr. 9, 2014 (KR) ..... 10-2014-0042221

(51) Int. Cl.
*G09G 3/36* (2006.01)

(52) U.S. Cl.
CPC ..... *G09G 3/3677* (2013.01); *G09G 2310/0289* (2013.01); *G09G 2310/08* (2013.01); *G09G 2320/0252* (2013.01)

(58) Field of Classification Search
CPC ..... G09G 3/36; G09G 3/3677; G09G 2310/0289; G09G 2310/08; G09G 2300/08
USPC ..... 345/211, 690, 204
See application file for complete search history.

(56) References Cited

U.S. PATENT DOCUMENTS 4,702,560 A * 10/1987 Endo ..... G09G 3/3644 345/99
8,054,123 B2 * 11/2011 Ha ..... H03K 19/018528 326/62
2007/0188431 A1 * 8/2007 Sato ..... G09G 3/3677 345/90
2009/0201233 A1 * 8/2009 Yamashita ..... G09G 3/3233 345/80
2011/0273430 A1 * 11/2011 Chia ..... G09G 3/3648 345/212

FOREIGN PATENT DOCUMENTS

KR 2003-0054896 A 7/2003
KR 2005-0076166 A 7/2005
KR 2008-0054065 A 6/2008
KR 10-2012-0073824 7/2012

OTHER PUBLICATIONS

Office Action for Korean Application No. 10-2014-0042221 dated Feb. 8, 2015.

* cited by examiner

*Primary Examiner* — David Vu
*Assistant Examiner* — Jonathan Han
(74) *Attorney, Agent, or Firm* — Patterson Thuente Pedersen, P.A.

(57) ABSTRACT

A gate driver is disclosed. The disclosed gate driver includes a shift register configured to generate a shift signal. The shift signal is based on a gate start signal and a gate clock signal. The gate driver further includes a gate drive signal generator configured to generate a gate drive signal. The gate drive signal is based on a gate control signal and the shift signal. The rising edge of the gate control signal precedes the falling edge of the shift signal, and the falling edge of the gate control signal follows the falling edge of the shift signal. The gate drive signal falls from a second voltage to a third voltage in response to the falling edge of the shift signal and rises from the third voltage to a first voltage in response to the falling edge of the gate control signal. The first voltage is higher than the third voltage but lower than the second voltage.

14 Claims, 6 Drawing Sheets

| GS1 | OD | LO1 | LO2 | OD_C | OD_CB |
|---|---|---|---|---|---|
| L | L | L | L | L | H |
| L | H | H | H | H | L |
| H | L | H | H | H | L |
| H | H | H | H | H | L |

GATE DRIVER AND DISPLAY APPARATUS INCLUDING THE SAME

The present application claims priority under 35 U.S.C. §§119 and 365 to Korean Patent Application No. 10-2014-0042221 (filed on Apr. 9, 2014), which is herein incorporated by reference in its entirety.

BACKGROUND OF THE INVENTION

1. Field of the Invention

The present disclosure relates to a gate driver and a display apparatus including the same.

2. Discussion of the Related Art

A display apparatus displays an image. Such a display apparatus may include a display panel having a pixel matrix, a data driver for supplying a data voltage to data lines of the display panel, and a gate driver for generating a gate signal (or gate pulse) to drive gate lines of the display panel.

The gate driver may sequentially supply the gate signal to the gate lines of the display panel. Each gate signal turns a pixel transistor on or off. At the same time, each pixel cell may store the data voltage supplied by the data driver.

When the turn-off time of the pixel transistor is delayed, the voltage stored in a pixel cell may experience voltage loss. This can delay the expression time of liquid crystal pixels, resulting in decreased display refresh times and an overall reduction in image quality.

SUMMARY OF THE INVENTION

Embodiments of the present disclosure provide a gate driver capable of preventing loss of a data voltage stored in a pixel cell and reducing expression time of liquid crystal pixels by shortening the falling time of gate signals, and a display apparatus including the same.

Exemplary advantages, objects, and features of the embodiments are set forth in the description which follows. The structure described in the written description, claims, and appended drawings can enable the objectives and other advantages of the disclosed, and other, embodiments.

In some embodiments described herein, a gate driver includes a shift register, which generates a shift signal based on a gate start signal and a gate clock signal, and a gate drive signal generator, which generates a gate drive signal based on a gate control signal and the shift signal. A rising edge of the gate control signal precedes a falling edge of the shift signal and a falling edge of the gate control signal follows the falling edge of the shift signal. The gate drive signal falls from a second voltage to a third voltage in response to the falling edge of the shift signal and rises from the third voltage to a first voltage in response to the falling edge of the gate control signal. The first voltage is higher than the third voltage, but lower than the second voltage.

The gate driver may further include a level-shifting unit for shifting the voltage level of the shift signal and outputting a first level shift signal level-shifting.

The gate drive signal generator may include a first transistor. The first transistor may include a first drain, a first gate to which the first level shift signal is input, and a first source to which the second voltage is applied. The gate drive signal generator may further include a second transistor. The second transistor may include a second gate, a second drain connected to the first drain, and a second source to which the third voltage is applied. The gate drive signal generator may further include a third transistor. The third transistor may include a third gate, a third drain connected to the first drain, and a third source to which the first voltage is applied; and a logic circuit that activates or deactivates the second and third transistors based on the first level shift signal, the shift signal, and the gate control signal.

Based on the shift signal and the gate control signal, the logic circuit may use the first level shift signal to activate the second and third transistors.

The logic circuit may include a logic control signal generator that generates a first logic control signal and a second logic control signal based on the shift signal and the gate control signal. The second logic control signal may be an inverted signal of the first logic control signal.; The logic circuit may further include a first logic unit that supplies the first level shift signal, based on the first and second logic control signals, to the second gate of the second transistor. The logic circuit may also include a second logic unit that supplies the first level shift signal, based on the first and second logic control signals, to the third gate of the third transistor.

The first logic unit may include a first pass transistor. The first pass transistor may include an input stage to which the first shift signal is input, an output stage connected to the second gate, a first control stage to which the first logic control signal is input, and a second control stage to which the second logic control signal is input. The first logic unit may also include a first logic transistor. The first logic transistor may include a gate connected to the second control stage of the first pass transistor, a source to which the third voltage is applied, and a drain connected to the second gate.

The second logic unit may include a second pass transistor. The second pass transistor may include an input stage to which the first shift signal is input, an output stage connected to the third gate, a first control stage to which the second logic control signal is input, and a second control stage to which the first logic control signal is input. The second logic unit may also include a second logic transistor. The second logic transistor may include a gate connected to the second control stage of the second pass transistor, a source to which the first voltage is applied, and a drain connected to the third gate.

Each of the first and second pass transistors may include a P-type metal-oxide-semiconductor (PMOS) transistor and a N-type metal-oxide-semiconductor (NMOS) transistor. The first control stage may be a gate of the NMOS transistor. The second control stage may be a gate of the PMOS transistor.

The level-shifting unit may include an inverter that inverts the shift signal, and a first level-shifter that shifts the level of the inverted signal level-shifting.

The level-shifting unit may also be an inverting level-shifter.

The logic control signal generator may include an OR gate that performs an OR operation on the shift signal and the gate control signal and outputs a first logic signal. The logic control signal generator may also include an SR flip-flop that inputs the shift signal to a set terminal, inputs the first logic signal to a reset terminal, and outputs a second logic signal. The logic control signal generator may further include a second level-shifter that shifts the voltage of the first logic signal and outputs first and second logic control signals.

The gate drive signal may rise from the first voltage to the second voltage in response to a rising edge of the shift signal.

In another embodiment, a gate driver includes a shift register for generating a shift signal based on a gate start signal and a gate clock signal. The gate driver also includes a gate drive signal generator for generating a gate drive signal based on a gate control signal and the shift signal. A rising edge of the gate control signal temporally overlaps with a first level period of the shift signal, a falling edge of the gate control signal temporally overlaps with a second level period of the shift signal, a falling edge of the shift signal temporally overlap with a first level period of the gate control signal, and the first level is higher than the second level. Further, the gate drive signal falls from a second voltage to a third voltage in response to the falling edge of the shift signal. The gate drive signal also rises from the third voltage to a first voltage in response to the falling edge of the gate control signal. The first voltage is higher than the third voltage but lower than the second voltage.

The gate drive signal may rise from the first voltage to the second voltage in response to a rising edge of the shift signal.

In another embodiment, a display apparatus includes a display panel. The display panel includes gate lines, data lines, and pixels connected to the gate and data lines. The display panel also includes a gate driver that generates a gate drive signal based on a shift signal and a gate control signal and supplies the gate drive signal to the gate lines. A rising edge of the gate control signal precedes a falling edge of the shift signal and a falling edge of the gate control signal follows the falling edge of the shift signal. The gate drive signal falls from a high level to a first low level at the falling edge of the shift signal and subsequently rises from the first low level to a second low level at the falling edge of the gate control signal.

The display apparatus may further include a timing controller that generates the gate drive signal based on a gate start signal and a gate clock signal.

The display apparatus may further include a data driver for driving the data lines.

Both the foregoing general description and the following detailed description of the present invention are exemplary, explanatory, and intended to provide further explanation of the invention as claimed.

BRIEF DESCRIPTION OF THE DRAWINGS

The accompanying drawings, which are intended to provide further understanding of the invention and are incorporated in and constitute a part of this application, illustrate embodiment(s) of the invention. Along with the description, these drawings explain the principles of the invention. In the drawings.

DETAILED DESCRIPTION OF THE INVENTION

Figure 1:
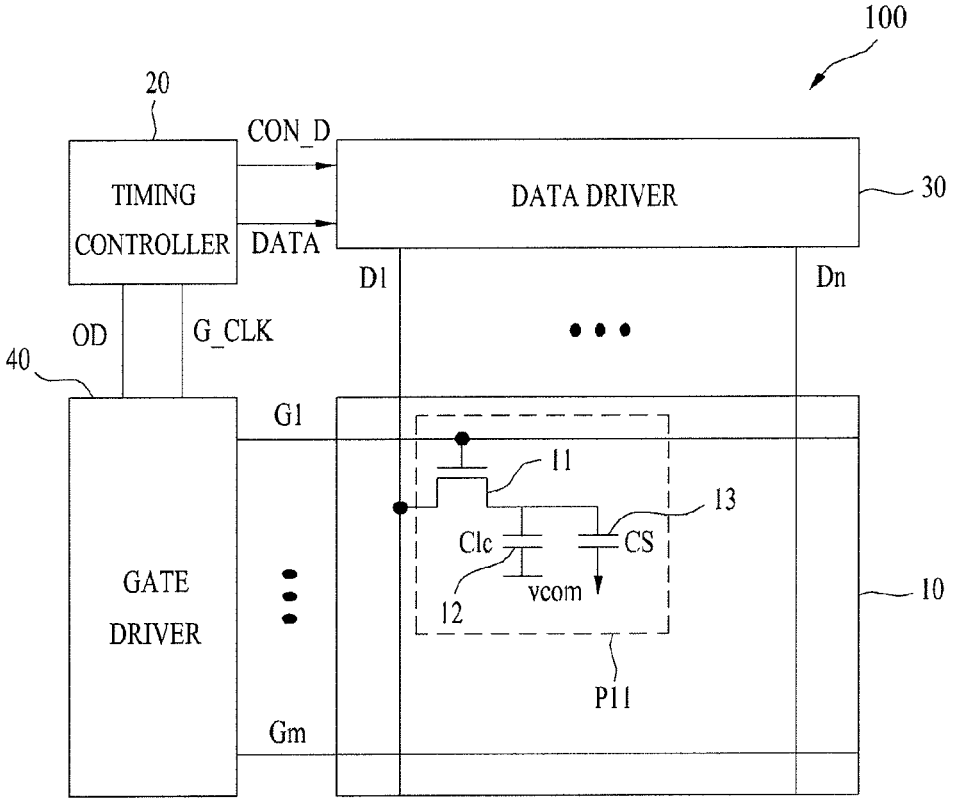
FIG. 1 is a diagram illustrating a configuration of a display apparatus according to one or more embodiments of the present disclosure.

Hereinafter, embodiments of the present disclosure will be described in detail with reference to the numbered drawings for better understanding. In the following description of the various embodiments, it will be understood that, when an element such as a layer, film, region, pattern, or structure is referred to as being "on" or "under" another element, it can be directly on or under another element or one or more intervening elements may also be present. In addition, terms such as "on" or "under" should be understood on the basis of the drawings.

In the drawings, dimensions of layers may be exaggerated, omitted, or schematically illustrated for clarity and convenience of description. In addition, dimensions of constituent elements do not entirely reflect actual dimensions thereof. The same reference numerals denote the same constituent elements.

FIG. 1 illustrates an embodiment of a display apparatus 100 according to one or more embodiments of the present disclosure.

Referring to FIG. 1, the display apparatus 100 includes a display panel 10, a timing controller 20, a data driver 30, and a gate driver 40.

In some embodiments, the display panel 10 may include gate lines G1 to Gm (m being a natural number greater than 1 (m>1)) arranged in rows, data lines D1 to Dn (n being a natural number greater than 1 (n>1)) arranged in columns, and a pixel Pnm (e.g., n=1 and m=1) connected to the gate line Gm (e.g., m=1) and data line Dn (e.g., n=1).

The display panel 10 may include a plurality of pixels P11 to Pnm arranged in matrix form. Each pixel Pnm may include a pixel transistor 11, a pixel capacitor 12, which is a liquid crystal cell, and a storage capacitor 13.

In some embodiments, the pixel transistor 11 of each pixel (e.g., P11) may have a gate connected to the corresponding gate line (e.g., G1), a source connected to the corresponding data line (e.g., D1), and a drain. The drain may be connected to one end of the pixel capacitor 12, which is a liquid crystal cell Clc. The drain may also be connected to the storage capacitor 13.

A common voltage Vcom may be supplied to the other end of the pixel capacitor 122. When the gate driver activates pixel transistor 11, the storage capacitor 13 charges to a data voltage supplied from the data line therein, to keep the voltage of the liquid crystal cell Clc constant.

The timing controller 20 sends, to the data driver 30 and gate driver 40, control signals that control the data driver 30 and gate driver 40.

For example, the timing controller 20 may supply data DATA and a data control signal CON_D to the data driver 30. Or the timing controller 20 may supply a gate clock signal G_CLK, a gate start signal GSS, and a gate control signal OD to the gate driver 40.

The data driver 30 may include a plurality of data drivers. The data driver 30 receives the data DATA and data control signal CON_D from the timing controller 20.

In response to the data control signal CON_D, the data driver 30 may supply the data DATA to the data lines.

For example, the data driver 30 may generate an analog signal corresponding to digital data received from the timing controller 20—namely, the data DATA—and may send the generated analog signal to data lines D1 to Dn.

The gate driver 40 receives the gate clock signal G_CLK, gate start signal GSS, and gate control signal OD from the timing controller 20.

Based on the received gate clock signal G_CLK, gate start signal GSS, and gate control signal OD, the gate driver 40 generates a gate drive signal GDS to drive the gate lines G1 to Gm. The gate driver 40 supplies the generated gate drive signal to the gate lines G1 to Gm.

Figure 2:
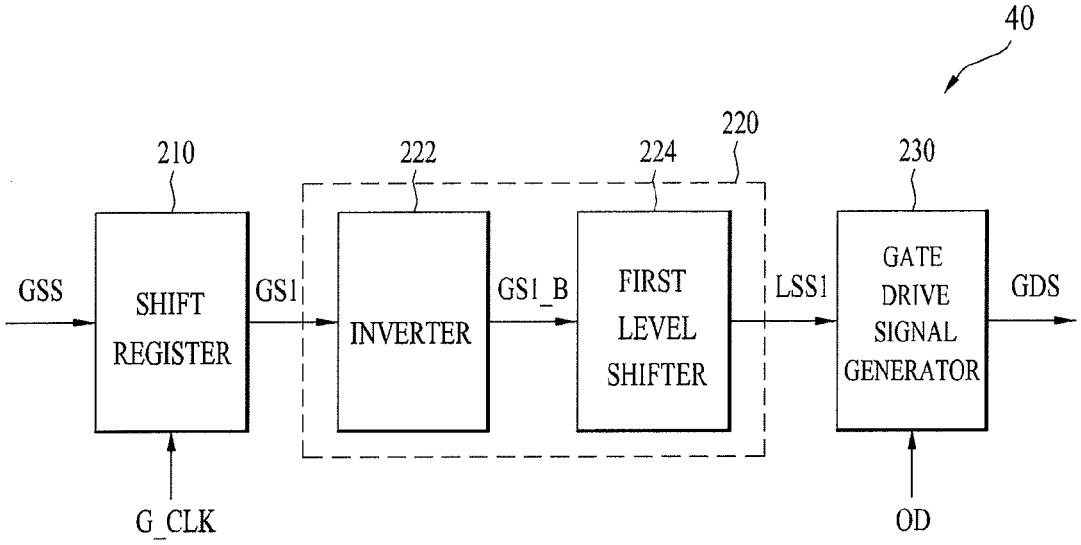
FIG. 2 is a diagram according to one or more embodiments of the present disclosure illustrating a configuration of a gate driver illustrated in FIG. 1.

FIG. 2 illustrates an embodiment of the gate driver 40 illustrated in FIG. 1.

Referring to FIG. 2, the gate driver 40 may include a shift register 210, a level-shifting unit 220, and a gate drive signal generator 230.

The shift register 210 receives the gate start signal GSS and gate clock signal G_CLK from the timing controller 20, shifts the received gate start signal GSS in response to the received gate clock signal G_CLK and, outputs a gate shift signal GS1.

The gate start signal GSS may signal the gate driver to start driving the gate lines. The shift register 210 may use the gate clock signal G_CLK to generate a shift signal GS1 that sequentially drives the gate lines G1 to Gm. Alternatively, the shift register 210 may generate the shift signal GS1 through a plurality of flip-flops.

The level-shifting unit 220 shifts the level of the shift signal GS1 and outputs the level-shifted signal as a first level shift signal LSS1.

For example, the level-shifting unit 220 may shift the level of the shift signal GS1 to a level capable of activating the first to third transistors 301, 302, and 303 included in the gate drive signal generator 230.

The level-shifting unit 220 may include an inverter 222 and a first level-shifter 224.

The inverter 222 may invert the shift signal GS1, and may output an inverted signal GS1_B.

The first level-shifter 224 may level-shift the inverted signal GS1_B, and may output the first level shift signal LSS1.

The level-shifting unit 220 illustrated in FIG. 2 has an arrangement in which the inverter 222 is arranged upstream of the level-shifter 224. Of course, embodiments are not limited to the arrangement described above.

Alternatively, some embodiments may arrange the inverter 222 downstream of the level-shifter 224. Other embodiments may omit the inverter 222. And further embodiments may omit the inverter 222 and, in place, include a buffer (not shown) between the shift register 210 and the first level-shifter 224. An output from the shift register 210 may be input to the buffer, and an output from the buffer may be input to the first level-shifter 224.

In another embodiment, the level-shifting unit 220 may be an inverting level-shifter. For example, the level-shifting unit 220 may invert the shift signal GS1 and may level-shift the inverted shift signal. Alternatively, the level-shifting unit 220 may level-shift the shift signal GS1 and may invert the level-shifted shift signal GS1.

The gate drive signal generator 230 may generate the gate drive signal GDS based on the first level shift signal LSS1 and gate control signal OD.

Figure 7:
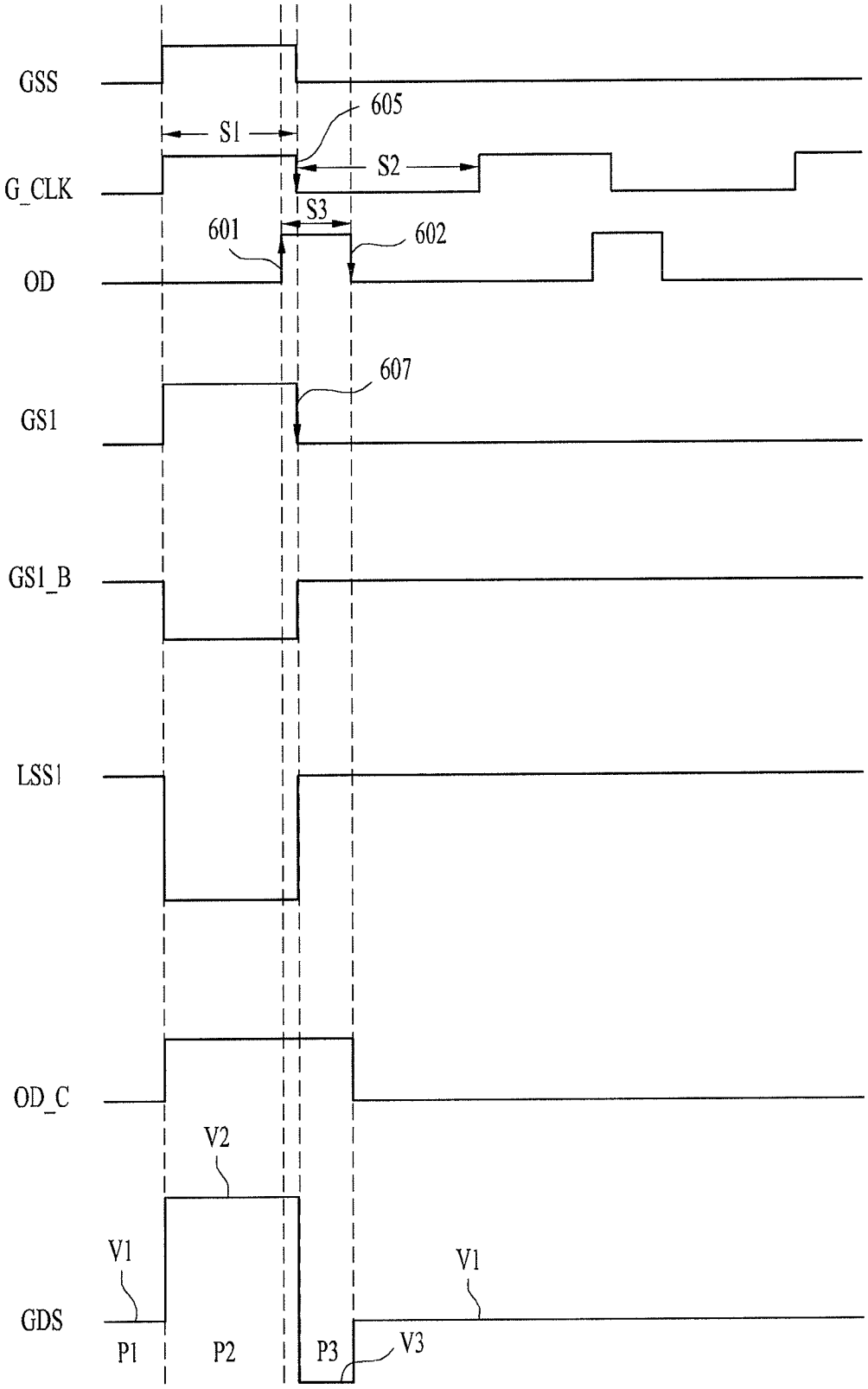
FIG. 7 is a timing diagram of a gate drive signal, according to one or more embodiments of the present invention, generated by the gate drive signal generator illustrated in FIG. 2.

FIG. 7 is a timing diagram of the gate drive signal GDS generated by the gate drive signal generator 230, illustrated above in FIG. 2.

Referring to FIG. 7, a rising edge 601 of the gate control signal OD precedes a falling edge 605 of the gate clock signal G_CLK, and a falling edge 602 of the gate control signal OD follows the falling edge 605 of the gate clock signal G_CLK.

The rising edge 601 of the gate control signal OD may temporally overlap with a first level period S1 of the gate clock signal G_CLK, and the falling edge 602 of the gate control signal OD may temporally overlap with a second level period S2 of the gate clock signal G_CLK. Here, the "first level" and "second level" may be logic levels or voltage levels. The first level may be higher than the second level. For example, the first level may be a high level, and the second level may be a low level.

The falling edge 605 of the gate clock signal G_CLK may temporally overlap with a first level period S3 of the gate control signal OD.

Next, this disclosure describes the relationship between the gate control signal OD and the shift signal GS1.

The rising edge 601 of the gate control signal OD may precede a falling edge 607 of the shift signal GS1, and the falling edge 602 of the gate control signal OD follows the falling edge 607 of the shift signal GS1.

The rising edge 601 of the gate control signal OD may temporally overlap with a first level period of the shift signal GS1, and the falling edge 602 of the gate control signal OD may temporally overlap with a second level period S2 of the shift signal GS1.

The falling edge 607 of the shift signal GS1 may temporally overlap with the first level period S3 of the gate control signal OD.

The gate drive signal GDS may rise from a first voltage V1 to a second voltage V2 in response to the rising edge of the shift signal GS1.

The gate drive signal GDS may fall from a high level (e.g., the second voltage V2) to a first low level (e.g., a third voltage V3) in response to the falling edge 607 of the shift signal GS1.

After falling to the first low level, the gate drive signal GDS may rise from the first low level (e.g., the third voltage V3) to a second low level (e.g., the first voltage V1) in response to the falling edge 602 of the gate control signal OD.

The second low level (e.g., the first voltage V1) may be higher than the first low level (e.g., the third voltage V3), but lower than the high level (e.g., the second voltage V2).

In a first period P1 in which the shift signal GS1 and gate clock signal G_CLK have the second level, the gate drive signal GDS may have the second low level (e.g., the first voltage V1).

In some embodiments, the first voltage V1 may be −5 to 0V, the second voltage V2 may be 10 to 25V, and the third voltage V3 may be −15 to −5V. Of course, embodiments are not limited to these conditions.

When the shift signal GS1 and gate clock signal G_CLK rise from the second level to the first level, the gate drive signal GDS may rise from the first voltage V1 to the second voltage V2.

In a second period P2, where the shift signal GS1 and gate clock signal G_CLK have the first level, the gate drive signal GDS may have the second voltage V2.

When the shift signal GS1 and gate clock signal G_CLK fall from the first level to the second level and the gate control signal OD has the first level, the gate drive signal GDS may fall from the second voltage V2 to the third voltage V3.

In a third period P3, where the shift signal GS1 and gate clock signal G_CLK have returned to the second level and the gate control signal OD has the first level, the gate drive signal GDS may have the third voltage V3.

When the shift signal GS1 and gate clock signal G_CLK are at the second level and the level of the gate control signal OD falls from the first level to the second level, the gate drive signal GDS may rise from the third voltage V3 to the first voltage V1.

In a period following the third period P3, namely, a fourth period P4 in which the shift signal GS1 is not at the first level, the gate drive signal GDS may have the first voltage V1.

The first voltage V1 may deactivate the pixel transistors 11 connected to the gate lines G1 to Gm, and the second voltage V2 may activate the pixel transistors 11.

When the gate drive signal GDS has a voltage waveform that falls from the activation voltage V2 to the third voltage V3, which is lower than the deactivation voltage V1, and the gate drive signal GDS subsequently rises to the deactivation voltage V1, it may be possible to reduce the time necessary to deactivate the pixel transistors 11.

Figure 3:
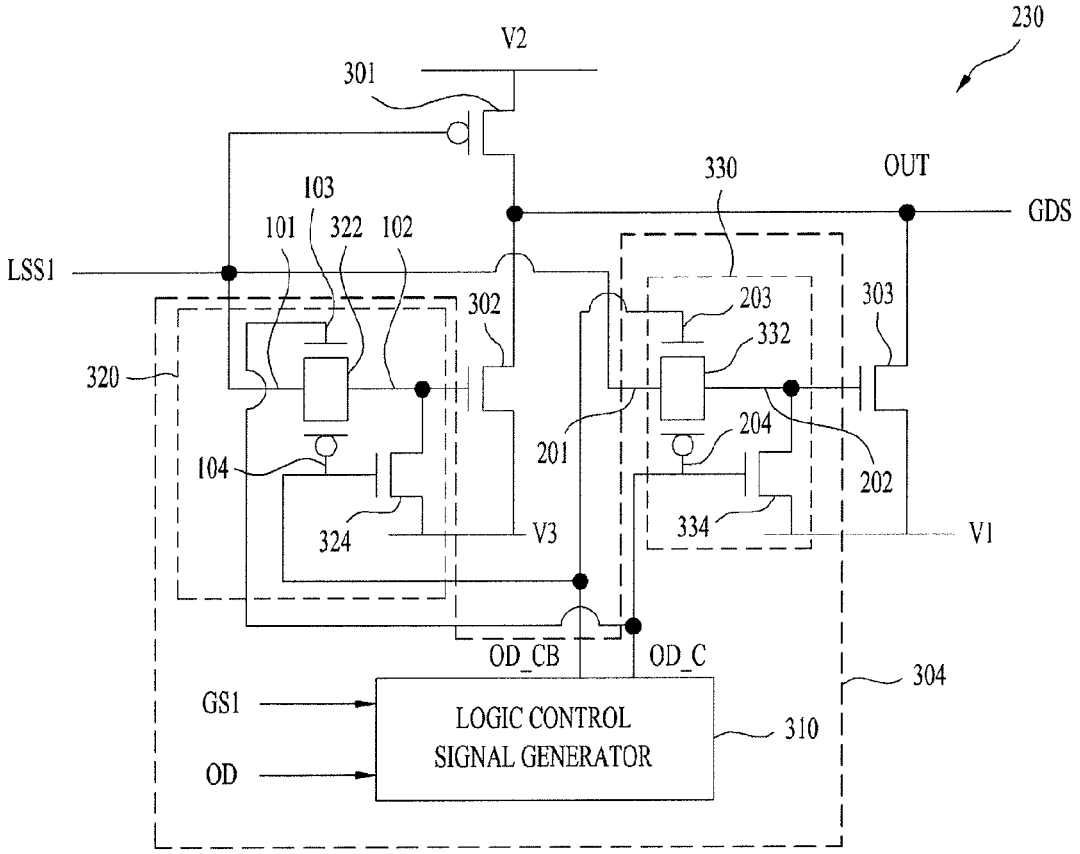
FIG. 3 is a diagram according to one or more embodiments of the present disclosure illustrating a gate drive signal generator illustrated in FIG. 2.

FIG. 3 illustrates an embodiment of the gate drive signal generator 230, illustrated above in FIG. 2.

Referring to FIG. 3, the gate drive signal generator 230 includes a first transistor 301, a second transistor 302, a third transistor 303, and a logic circuit 304.

The first transistor 301 includes a first drain, a first gate into which the first level shift signal LSS1 is input, and a first source to which the second voltage V2 is applied.

The second transistor 302 includes a second gate, a second drain connected to the first drain of the first transistor 301, and a second source to which the third voltage V3 is applied.

The third transistor 303 includes a third gate, a third drain connected to the first drain of the first transistor 301, and a third source, to which the first voltage V1 is applied.

The first transistor 301 may be a first-conductivity type transistor. The second and third transistors 302 and 303 may be second-conductivity type transistors. The first conductivity type may be p-type, and the second conductivity type may be n-type.

For example, the first transistor 301 may be a P-type metal-oxide-semiconductor (PMOS) transistor, and the second and third transistors 302 and 303 may be N-type metal-oxide-semiconductor (NMOS) transistors. Of course, embodiments are not limited to the above-described conditions. In another embodiment, the first transistor 301 may be an NMOS transistor, and the second and third transistors 302 and 303 may be PMOS transistors.

The gate drive signal generator 230 may output a gate drive signal GDS having the second voltage V2 when the first level shift signal LSS1 has a second level (e.g., a low logic level).

Based on the shift signal GS1 and gate control signal OD, the logic circuit 304 may control the first level shift signal LSS1 to turn on one of the second and third transistors 302 and 303.

The logic circuit 304 receives the first level shift signal LSS1 from the first level-shifter 224, the shift signal GS1 from the shift register 210, and the gate control signal OD from the timing controller.

When the level of the first level shift signal LSS1 rises from the second level to the first level and the gate control signal OD has the first level, the logic circuit 304 may output a gate drive signal GDS falling from the second voltage V2 to the third voltage V3. Alternately, the logic circuit 304 may output a gate drive signal GDS having the third voltage V3 during the third period P3 in which the first level shift signal LSS1 has the first level and the gate control signal OD has the first level.

When the first level shift signal LSS1 has the first level and the level of the gate control signal OD falls from the first level to the second level, the logic circuit 304 may output a gate drive signal GDS rising from the third voltage V3 to the first voltage V1.

When the first level shift signal LSS1 has the first level and the shift signal GS1 and gate drive signal GDS have the second level, the logic circuit 304 may output a gate drive signal GDS with the first voltage V1.

The logic circuit 304 includes a logic control signal generator 310, a first logic unit 320, and a second logic unit 330.

Based on the shift signal GS1 and gate control signal OD, the logic control signal generator 310 generates a first logic control signal OD_C and a second logic control signal OD_CB. The second logic control signal OD_CB may be an inverted signal of the first logic control signal OD_C.

Figure 4:
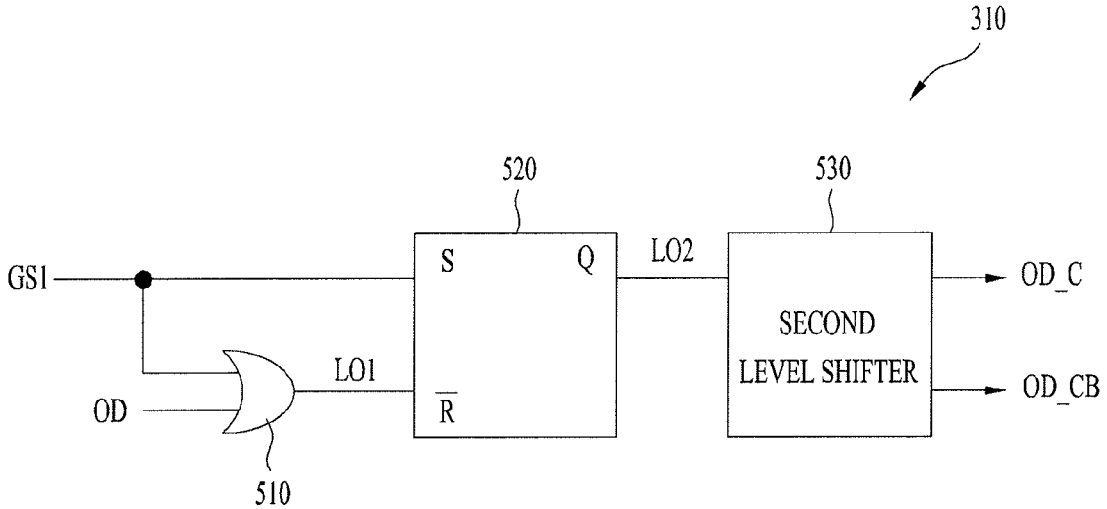
FIG. 4 is a diagram according to one or more embodiments of the present invention illustrating a logic control signal generator illustrated in FIG. 3.

FIG. 4 illustrates an embodiment of the logic control signal generator 310 illustrated in FIG. 3.

Referring to FIG. 4, the logic control signal generator 310 includes a logic operator 510, an SR flip-flop 520, and a second level-shifter 530.

The logic operator's 510 inputs are the shift signal GS1 and gate control signal OD. The logic operator's 510 output is a first logic signal LO1 according to the result of logic operation.

For example, the logic operator 510 may be an OR gate. In this case, the logic operator 510 may perform an OR operation on the shift signal GS1 and gate control signal OD and output a first logic signal LO1.

The SR flip-flop 520 includes a set terminal and a reset terminal. The shift signal GS1 is the input for the set terminal; the first logic signal LO1 is the input for the reset terminal. The SR flip-flop outputs a second logic signal LO2.

The second level-shifter 530 level shifts the voltage of the first logic signal LO2, and generates first and second logic control signals OD_C and OD_CB according to the result of level-shifting.

The second level-shifter 530 may convert the voltage of the second logic signal LO2 into a voltage capable of turning on the first to third transistors 301, 302, and 303 included in the gate drive signal generator 230.

Figures 5, 6A:
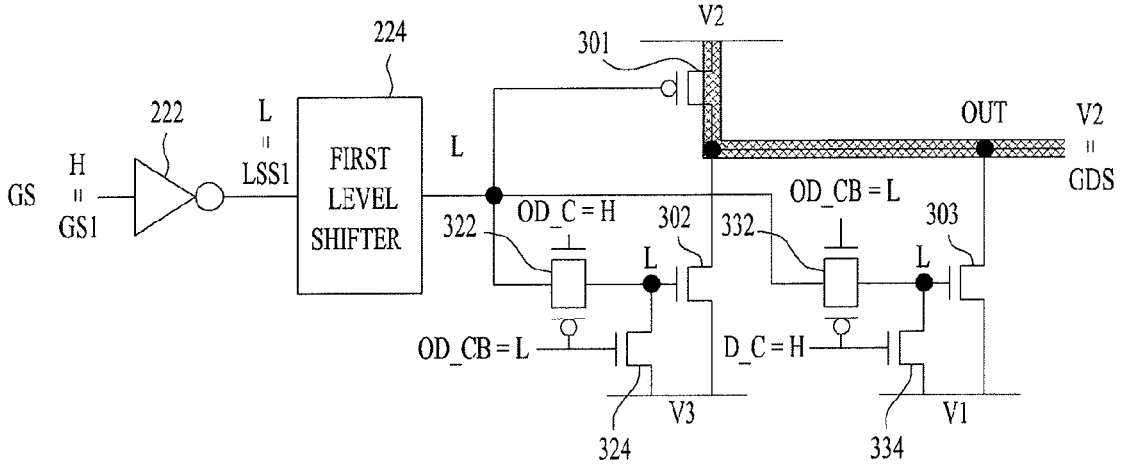
FIG. 5 is a logic table of first and second logic signals.
FIGS. 6A to 6C are diagrams explaining operation of the gate drive signal generator.

FIG. 5 is a logic table of the first and second logic signals LO1 and LO2.

When the shift signal GS1 has the high level, the first logic control signal OD_C may have the high level and the second logic control signal OD_CB may have the low level.

Even when the gate control signal OD shifts from the low level to the high level, the levels of the first and second logic control signals OD_C and OD_CB remain unchanged so long as the shift signal GS1 maintains the high level. This is because the SR flip-flop 520 maintains its output in a previous state.

When the shift signal GS1 has the low level, the levels of the first and second logic control signals OD_C and OD_CB may be shifted as illustrated in FIG. 5.

Based on the first and second logic control signals OD_C and OD_CB, the first logic unit 320 may supply the first level shift signal LSS1 to the gate of the second transistor 302.

The first logic unit 320 includes a first pass transistor 322 and a first logic transistor 324.

The first pass transistor 322 includes an input stage 101 to which the first shift signal LSS1 is input, an output stage 102 connected to the gate of the second transistor 302, a first control stage 103 to which the first logic control signal OD_C is input, and a second control stage 104 to which the second logic control signal OD_CB is input.

Based on the first and second logic control signals OD_C and OD_CB, the first pass transistor 322 may supply the first level shift signal LSS1 to the second gate of the second transistor 302.

The first pass transistor 322 may include a PMOS transistor and an NMOS transistor. The first control stage 103 may be a gate of the NMOS transistor, and the second control stage 104 may be a gate of the PMOS transistor.

The first logic transistor 324 may include a gate connected to the second control stage 104 of the first pass transistor 322, a source to which the third voltage V3 is applied, and a drain connected to the second gate of the second transistor 302.

Based on the first and second logic control signals OD_C and OD_CB, the second logic unit 330 may supply the first level shift signal LSS1 to the gate of the third transistor 303.

The second logic unit 330 includes a second pass transistor 332 and a second logic transistor 334.

The second pass transistor 332 includes an input stage 201 to which the first shift signal LSS1 is input, an output stage 202 connected to the gate of the third transistor 303, a first control stage 203 to which the second logic control signal OD_CB is input, and a second control stage 104 to which the first logic control signal OD_C is input.

Based on the first and second logic control signals OD_C and OD_CB, the second pass transistor 332 may supply the first level shift signal LSS1 to the gate of the third transistor 303.

The second pass transistor 332 may include a PMOS transistor and an NMOS transistor. The first control stage 203 may be a gate of the NMOS transistor, and the second control stage 204 may be a gate of the PMOS transistor.

The second logic transistor 334 may include a gate connected to the second control stage 204 of the second pass transistor 332, a source to which the first voltage V1 is applied, and a drain connected to the gate of the third transistor 303.

Figure 6B:
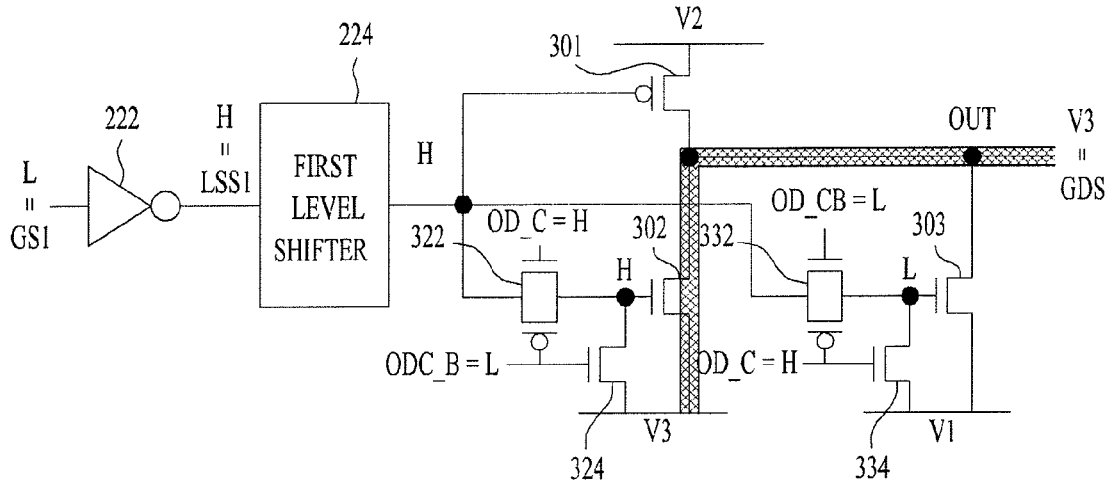
Figure 6C:
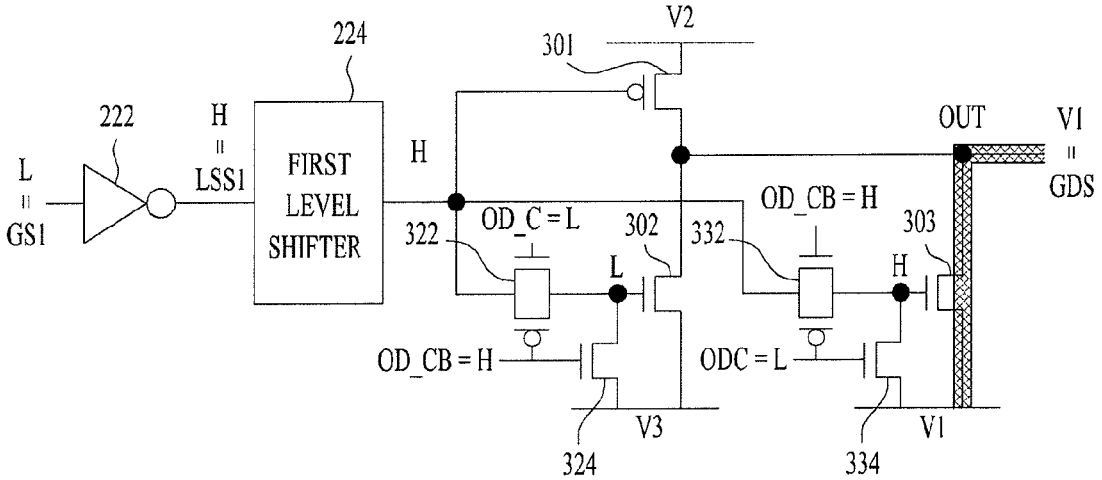

FIGS. 6A to 6C are diagrams explaining exemplary operation of the gate drive signal generator 230.

Referring to FIGS. 6A and 7, when the shift signal GS1 has a high level H, an output of the first level-shifter 224 may have a low level L, the first transistor 301 may be turned on, and an output OUT of the gate drive signal generator 230 may have the second voltage V2.

As illustrated in FIG. 5, when the shift signal GS1 has the high level H, the first logic control signal OD_C may have the high level H, and the second logic control signal OD_CB may have the low level L.

In response, the first and second logic control signals OD_C and OD_CB may activate the first pass transistor 322 and deactivate both the first logic transistor 324 and second transistor 302.

Further, the first and second logic control signals OD_C and OD_CB may deactivate the second pass transistor 332 activate the second logic transistor 334, and deactivate the third transistor 303.

Referring to FIGS. 5, 6B, and 7, when the shift signal GS1 has the low level L, an output of the first level-shifter 224 may have the high level H, and the first transistor 301 may be deactivated.

When the gate control signal OD has the high level H and the shift signal GS1 has the low level L, the first logic control signal OD_C may have the high level H, and the second logic control signal OD_CB may have the low level L.

In response to the first and second logic control signals OD_C and OD_CB, the first pass transistor 322 may transfer the output from the first level-shifter 224 to the second transistor 302, the first logic transistor 324 may be deactivated, the second transistor 302 may be activated, and the output OUT of the gate drive signal generator 230 may have the third voltage V3.

Further, the first and second logic control signals OD_C and OD_CB may deactivate the second pass transistor 332 and third transistor 303 and activate the second logic transistor 334. Consequently, the output OUT of the gate drive signal generator 230 may have the third voltage V3.

Referring to FIGS. 5, 6C, and 7, when the shift signal GS1 has the low level L and the gate control signal OD has the low level L, the first logic control signal OD_C may have the low level L and the second logic control signal OD_CB may have the high level H.

In response, the first and second logic control signals OD_C and OD_CB may deactivate the first pass transistor 322, activate the first logic transistor 324, and deactivate the second transistor 302.

Further, the first and second logic control signals OD_C and OD_CB may cause the second pass transistor 332 to transfer an output from the first level-shifter 224 to the gate of the third transistor 303, deactivate the second logic transistor 334, and activate the third transistor 303. Consequently, the output OUT of the gate drive signal generator 230 may have the first voltage V1.

In the embodiment, it may be possible to shorten an OFF time of the gate drive signal GDS because OFF voltages V3 and V1 having two different levels are applied in a sequential manner.

In the embodiment, shortening the falling time or deactivation time of the gate drive signal GDS may prevent loss of the output voltage of the data driver and shorten the expression time of liquid crystals.

Figure 8:
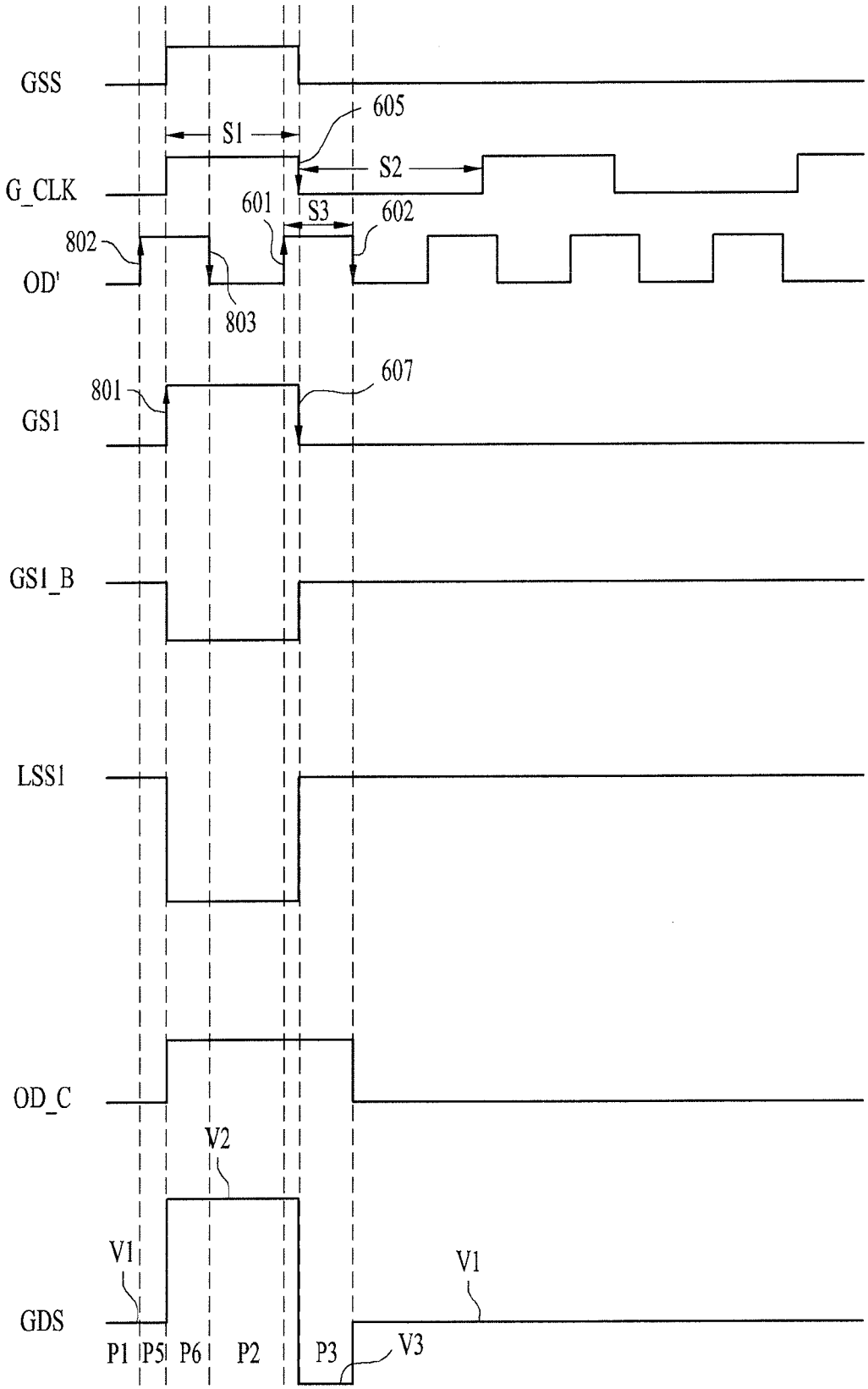
FIG. 8 is a timing diagram of a gate drive signal according to another embodiment different from that of FIG. 7.

FIG. 8 is a timing diagram of a gate drive signal according to an embodiment different from that of the timing diagram in FIG. 7. In FIG. 8, the same reference numerals as those of FIG. 7 designate the same constituent elements. For brevity, descriptions of these elements will not be repeated.

Referring to FIG. 8, a gate control signal OD' is an example of an alternative to the gate control signal OD illustrated in FIG. 7.

A rising edge 802 of the gate control signal OD' precedes a rising edge 801 of the shift signal GS1, and a falling edge 803 of the gate control signal OD' follows the rising edge 801 of the shift signal GS1.

The rising edge 802 of the gate control signal OD' may temporally overlap with a second level period of the shift signal GS1, and the falling edge 803 of the gate control signal OD' may temporally overlap with a first level period of the shift signal GS1.

The rising edge 801 of the shift signal GS1 may temporally overlap with a first level period of the gate control signal OD'.

Even when the gate control signal OD' shifts from the second level to the first level under the condition that the shift signal GS1 has the second level, the gate drive signal GDS may have the first voltage V1, as in the case of FIG. 7. The first and fifth periods P1 and P5 of the gate drive signal GDS in FIG. 8 may be equal to the first period P1 of FIG. 7.

Even when the gate control signal OD' shifts from the first level to the second level under the condition that the shift signal GS1 has the first level, the gate drive signal GDS may have the second voltage V2, as in the case of FIG. 7. The sixth and second periods P6 and P2 of the gate drive signal GDS in FIG. 8 may be equal to the second period P2 of FIG. 7.

In accordance with the embodiments, it may be possible to shorten a falling time of a gate signal, prevent loss of a data voltage stored in a pixel cell, and reduce the expression time of liquid crystals.

Other embodiments may be implemented in the form of a liquid crystal display device, a touch panel, a touch screen or the like, which includes the gate driver according to the above-described embodiment.

The embodiments as described above may include particular features, structures, or characteristics, but not every embodiment necessarily includes these particular features, structures, or characteristics. Furthermore, one of ordinary skill in the art from this disclosure may combine the particular features, structures or characteristics in each disclosed embodiment into one or more other suitable embodiments. Therefore, combinations of features of different embodiments are within the scope of the invention.

What is claimed is:

1. A gate driver for driving gate lines of a display panel comprising:

a first transistor including a first drain, a first gate to which a level shift signal is input, and a first source to which a first voltage is applied:

a second transistor including a second gate, a second drain connected to the first drain, and a second source to which a second voltage is applied;

a third transistor including a third gate, a third drain connected to the first drain and outputting a gate drive signal, and a third source to which a third voltage is applied;

a first pass transistor including a first input stage to which the level shift signal is input, a first output stage connected to the second gate, a first control stage to which a first logic control signal is input, and a second control stage to which a second logic control signal is input; and a second pass transistor including a second input stage to which the level shift signal is input, a second output stage connected to the third gate, a third control stage to which the second logic control signal is input, and a fourth control stage to which the first logic control signal is input, wherein the level shift signal is a level-shifted signal of the shift signal and the shift signal is a shifted signal of a gate start signal in response to a gate clock signal, wherein the first and the second pass transistors are controlled based on the first and second logic control signals and the first and second logic control signals are generated based on the shift signal and a gate control signal, and wherein a rising edge of the gate control signal precedes a falling edge of the shift signal, and a falling edge of the gate control signal follows the falling edge of the shift signal.

2. The gate driver for driving gate lines of a display panel according to claim 1, further comprising:

a level-shifting unit configured to shift the level of the shift signal and further configured to output the level shift signal.

3. The gate driver for driving gate lines of a display panel according to claim 1, wherein:

each of the first and second pass transistors comprises a P-type metal-oxide-semiconductor (PMOS) transistor and an N-type metal-oxide-semiconductor (NMOS) transistor; and each of the first control stage and the third control stage is a gate of the NMOS transistor and each of the second control stage and the fourth control stage is a gate of the PMOS transistor.

4. The gate driver for driving gate lines of a display panel according to claim 2, wherein the level-shifting unit comprises:

an inverter that inverts the shift signal and outputs an inverted signal; and a first level-shifter that level-shifts the inverted signal and outputs a signal as the level shift signal.

5. The gate driver for driving gate lines of a display panel according to claim 2, wherein the level-shifting unit is an inverting level-shifter.

6. The gate driver for driving gate lines of a display panel according to claim 1, further comprising:

an OR gate configured to perform an OR operation on the shift signal and the gate control signal and outputs a first logic signal;

an SR flip-flop configured to input the shift signal to a set terminal, input the first logic signal to a reset terminal and output a second logic signal; and a second level-shifter configured to shift a voltage of the first logic signal and output the first and second logic control signals.

7. The gate driver for driving gate lines of a display panel according to claim 1, wherein the gate drive signal rises from the third voltage to the first voltage in response to a rising edge of the shift signal.

8. The gate driver for driving gate lines of a display panel according to claim 1, wherein the gate drive signal rises from the second voltage to the third voltage in response to the falling edge of the gate control signal after the gate drive signal rises from the third voltage to the first voltage in response to the rising edge of the shift signal and falls from the first voltage to the second voltage in response to the falling edge of the shift signal, and wherein the third voltage is higher than the second voltage but lower than the first voltage.

9. The gate driver for driving gate lines of a display panel according to claim 1, wherein the level shift signal activates one of the second transistor and the third transistor based on the shift signal and the gate control signal.

10. The gate driver for driving gate lines of a display panel according to claim 1, wherein the second logic control signal is an inverted signal of the first logic control signal.

11. The gate driver for driving gate lines of a display panel according to claim 1, further comprising:

a first logic transistor including a fourth gate connected to the second control stage of the first pass transistor, a fourth source to which the third voltage is applied, and a drain connected to the second gate; and a second logic transistor including a fifth gate connected to the fourth control stage of the second pass transistor, a source to which the third voltage is applied, and a fifth drain connected to the third gate.

12. The gate driver for driving gate lines of a display panel according to claim 1, further comprising a shift register configured to shift the gate start signal based on the gate start signal and output the shift signal.

13. A gate driver for driving gate lines of a display panel comprising:

a first transistor including a first drain, a first gate to which a level shift signal is input, and a first source to which a first voltage is applied;

a second transistor including a second gate, a second drain connected to the first drain, and a second source to which a second voltage is applied;

a third transistor including a third gate, a third drain connected to the first drain and outputting a gate drive signal, and a third source to which a third voltage is applied;

a first pass transistor including a first input stage to which the level shift signal is input, a first output stage connected to the second gate, a first control stage to which a first logic control signal is input, and a second control stage to which a second logic control signal is input; and a second pass transistor including a second input stage to which the level shift signal is input, a second output stage connected to the third gate, a third control stage to which the second logic control signal is input, and a fourth control stage to which the first logic control signal is input, wherein the level shift signal is a level-shifted signal of the shift signal and the shift signal is a shifted signal of a gate start signal in response to a gate clock signal, and wherein the first logic control signal and the second logic control signal are generated based on the shift signal and a gate control signal.

14. A display apparatus comprising:

a display panel comprising gate lines, data lines, and pixels connected to the gate and data lines; and a gate driver configured driving the gate lines according to claim 1; and a data driver driving the data lines.

* * * * *